United States Patent [19]

Machen

[11] 4,124,188

[45] Nov. 7, 1978

[54] HINGE-FOOT FOR FOLDING FRAME

[76] Inventor: James F. Machen, 2495 Robinwood Ave., Toledo, Ohio 43620

[21] Appl. No.: 405,474

[22] Filed: Oct. 11, 1973

[51] Int. Cl.[2] ..... A47C 5/10

[52] U.S. Cl. ..... 248/188.6; 248/188.9; 297/45

[58] Field of Search ..... 248/188.9, 188.91, 166, 248/188.6; 16/42 R, 42 T, 43, 150; 24/81 AG, 73A; 297/45

[56] References Cited

U.S. PATENT DOCUMENTS

| | | | |
|---|---|---|---|
| 1,893,910 | 1/1933 | Silverman | 248/188.9 |
| 1,916,336 | 7/1933 | Schermerhorn | 248/188.9 |
| 2,691,410 | 10/1954 | Boucher | 297/45 |
| 3,398,425 | 8/1968 | Croxson et al. | 16/150 |
| 3,787,017 | 1/1974 | Sauer | 248/96 |

*Primary Examiner*—Roy D. Frazier

[57] ABSTRACT

A combined foot and hinge for a folding chair, stool, or table frame comprising a one-piece part molded of a self-hingeable thermoplastic material having rod sockets with foot pads joined together with a flexure web.

5 Claims, 5 Drawing Figures

HINGE-FOOT FOR FOLDING FRAME

Folding chairs constructed of steel rods known as "butterfly" chairs, have employed various methods of footing the folding frame to avoid harming floors or carpets. One common design incorporates short lengths of heavy walled rubber tubing adjacent on both sides to each lower hinged joint to form foot pads.

Such feet are simple and inexpensive, but have the disadvantages of unappealing appearance, shifting of the rubber tubing, rubber wearing through, and lack of functional relationship to the adjacent hinge.

The typical riveted joints at the frame feet are reasonably simple, but being fully exposed detract somewhat from the aesthetic appeal of the foot design, especially when the steel parts show rust resulting from age and weathering. Such a hinge design again lacks functional relationship to the adjacent foot pads.

Consequently, it is as object of this invention to provide an improved foot design that is functional, attractive in appearance and simple.

Another object of this invention is to provide a foot design that if possible combines the hinge element into a single one-piece dual-purpose element.

Another object is to provide a foot that offers long-term wear and weather resistance.

Another object is to provide a foot that may be injection molded at low cost.

Other objects and advantages will become more apparent from the following description taken together with the drawings of a preferred embodiment, in which.

Figure 1:
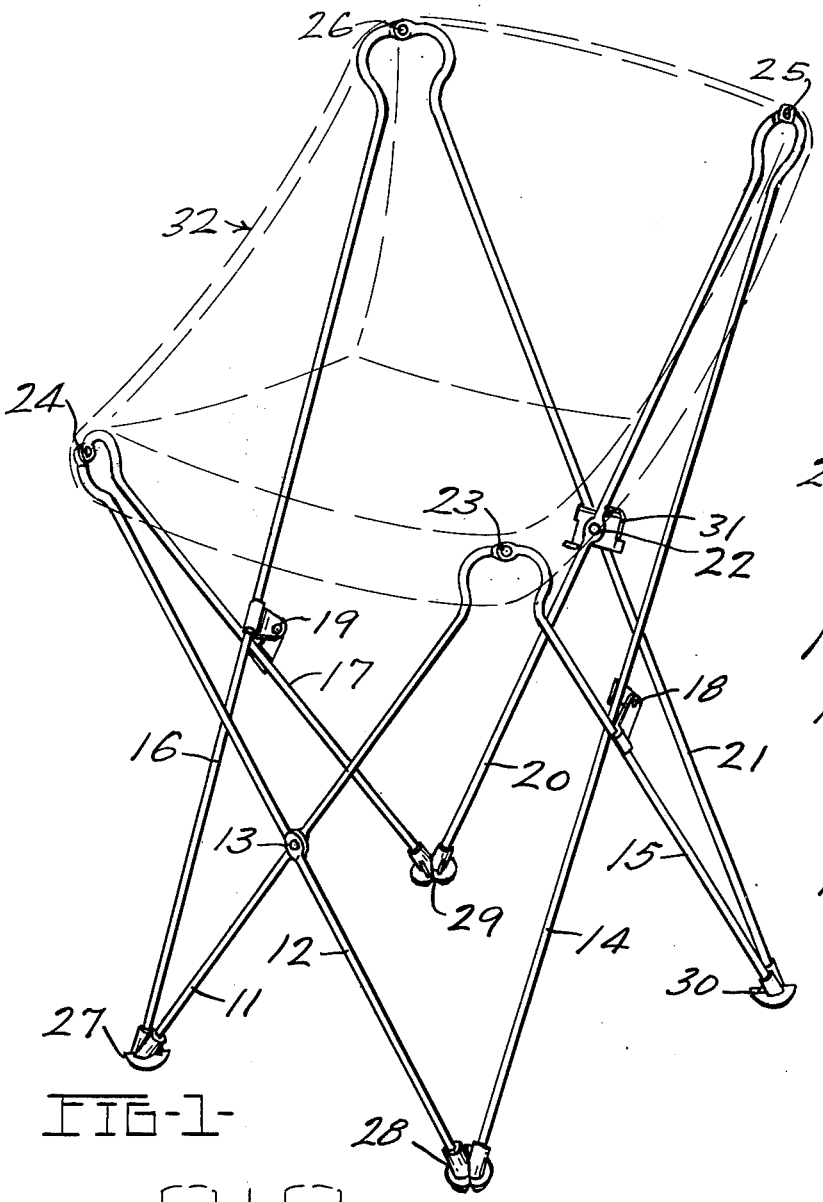
FIG. 1 is a perspective view of an example of a folding chair frame employing the combined foot and hinge of this invention.
Figure 2:
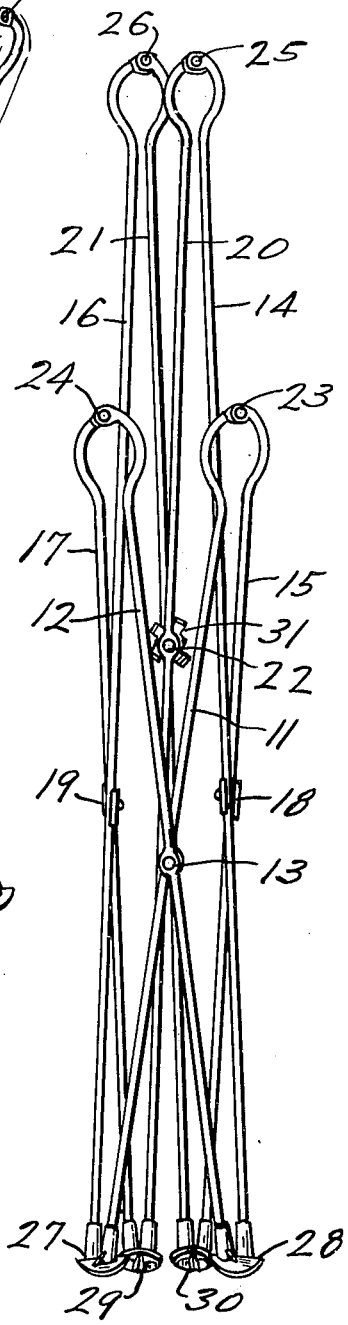
FIG. 2 is front view of the same chair in a nearly fully folded condition.

Referring to FIGS. 1 and 2, front rods 11 & 12 are hinged at intermediate pivot point 13 located at the crossing point of their respective centerlines. Side rods 14 & 15, and 16 & 17 are hinged at intermediate pivot points 18 & 19 respectively. Back rods 20 & 21 are hinged at intermediate pivot point 22 located at the crossing point of their respective centerlines.

Front rods 11 & 12 are also connected and hinged at their lower ends to the lower ends of side rods 16 and 14, respectively, by means of foot-hinges 27 & 28, respectively. Back rods 20 & 21 are also connected and hinged at their lower ends to the lower ends of side rods 17 & 15, respectively, by means of foot-hinges 29 & 30, respectively.

FIG. 2 illustrates generally the mode of folding of the chair frame of this invention as it approaches the folded condition. Top hinges 23, 24, 25, & 26, intermediate hinges 13, 18, 19, & 22 and foot-hinges 27, 28, 29, & 30 maintain the similarity of geometry while all of the eight rods become more parallel in their alignment, approaching the substantially parallel alignment of the fully closed frame. Note that the center of hinge 26 lies along a straight line parallel to and closely adjacent to rods 16 & 21, as shown in FIG. 2.

Lugged clip 31 acts as a stop to limit the degree to which the frame may open. Cover-seat 32, shown in phantom lines, fits over the chair frame at hinged connections 23, 24, 25, & 26. Seat 32 may be made of fabric, leather, or other sheet material. It is shown here as a related part of the folding frame shown, but is not specified in detail herein since it is not directly related to the foot-hinge of this invention.

The chair frame configuration shown and described also includes elements being claimed as a part of my co-pending application, Ser. No. 405,475, now U.S. Pat. No. 3,838,883.

Figure 3:
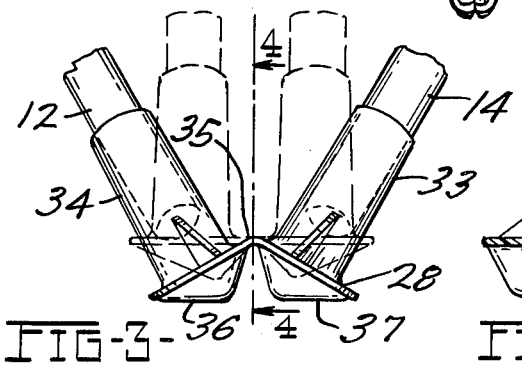
FIG. 3 is a partial auxillary view of the right-front combined foot and hinge to illustrate its typical application with such a frame.
Figure 4:
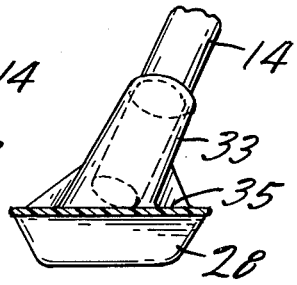
FIG. 4 is a cross-sectional view of the combined foot and hinge derived from FIG. 3.
Figure 5:
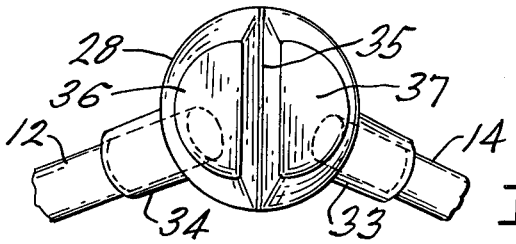
FIG. 5 is a bottom view of the combined foot and hinge.

Referring to FIG. 3, typical molded foot-hinge 28 has sockets 33 & 34 in which are anchored lower ends of front rod 12 and side rod 14, respectively. Web portion 35 acts as a flexure-hinge, as essential element of this invention. Closed ends 36 & 37 together with flexure-hinge 35 form an intermediate portion connecting between sockets 33 & 34. The thicker material at closed ends 36 & 37 also functions as wear pads at the areas of contact with the floor. Phantom lines show the foot-hinge in the fully folded condition wherein legs 14 & 16 reach a substantially parallel alignment. In use, web 35 is bent when the frame is open and straight when the frame is folded.

Flexability of the web may be achieved by molding the foot-hinge of a material which has sufficient strength and stiffness to form a solid connection, yet which will bend repeatedly without cracking or breaking.

Many rubberoid and plastic materials are known to have such a resistance to stress-cracking. Materials which have this property to a superior degree are considered to be "self-hingeable." Two excellent examples are polypropylene and polyallomer, both readily-molded thermoplastic materials suitable for this foot-hinge. They are also well suited from the stand-point of their wear-resisting and non-marking qualities.

In experimental testing on a foot-hinge similar to that shown in FIG. 3, more than 100,000 opening and closing bends through an angle of 45° were applied with the web carrying a tension load of 40 lbs., without failure. The foot was injection molded of general purpose polypropylene and the flexible web (i.e. 35) measured 0.075 inches thick and 1½ inches long.

Other embodiments of this invention employing identical or similar principles may be devised within the scope of the claims. Specifically, frames for stools or folding tables where the rod elements are all of equal length, and/or where six rather than eight rod elements are employed, are examples of related embodiments intended to be covered within the scope of the claims. Those skilled in the art will readily see that a variety of other such embodiments can be devised without departure from the principles set forth. Thus it will be understood that this invention is not limited to the specific construction shown and described except as so provided in the following claims.

I claim:

1. In a folding frame of the type described having at least one pair of leg elements, a combination foot and hinge of thermoplastic material comprising:

two sockets each having an open and a closed end;

said sockets attached respectively to said leg elements;

a bridge connecting said sockets at their closed ends at least one wear pad adjacent to one of said sockets;

a self-hingeable portion of reduced thickness in said bridge between said sockets;

all of said elements forming a single part.

2. A combination foot and hinge according to claim 1 wherein said self-hingeable portion is through an angle of at least 40°.

3. A combination foot and hinge of thermoplastic material comprising:

two sockets each having an open and a closed end;

said closed ends formed as foot pads;

a bridge connecting said foot pads;

a self-hingeable portion of reduced thickness in said bridge between said foot pads;

all of said elements comprising a single part.

4. A combination foot and hinge according to claim 3 wherein said self-hingeable portion is hingeable through an angle of at least 40°.

5. In a folding frame of the type described, a foot of thermoplastic material for a pair of leg elements comprising:

two sockets;

the lower ends of said leg elements terminating in and attached to said sockets;

at least one wear pad adjacent to one of said sockets;

a self-hingeable portion connecting said sockets;

said self-hingeable portion hingeable through an angle of at least 40°;

said sockets, wear pads, and self-hingeable portion comprising a sngle part.

* * * * *